US011648178B2

(12) United States Patent
Vlahinos

(10) Patent No.: US 11,648,178 B2
(45) Date of Patent: May 16, 2023

(54) MEDICAL PRODUCT TRANSPORTATION AND STORAGE ENCLOSURE WITH DIRECTED COOLING AND HEATING

(71) Applicant: Thaddeus Medical Systems, Inc., Rochester, MN (US)

(72) Inventor: Andreas Vlahinos, Castle Rock, CO (US)

(73) Assignee: Thaddeus Medical Systems, Inc., Rochester, MN (US)

( * ) Notice: Subject to any disclaimer, the term of this patent is extended or adjusted under 35 U.S.C. 154(b) by 1104 days.

(21) Appl. No.: 16/297,003

(22) Filed: Mar. 8, 2019

(65) Prior Publication Data

US 2019/0277553 A1 Sep. 12, 2019

Related U.S. Application Data

(60) Provisional application No. 62/640,531, filed on Mar. 8, 2018.

(51) Int. Cl.

| | |
|---|---|
| ***A61J 1/16*** | (2006.01) |
| ***F25D 17/06*** | (2006.01) |
| ***F25D 17/04*** | (2006.01) |

(52) U.S. Cl.
CPC ..... *A61J 1/165* (2013.01); *F25D 17/045* (2013.01); *F25D 17/06* (2013.01); *A61J 2200/42* (2013.01); *A61J 2200/44* (2013.01); *A61J 2200/50* (2013.01)

(58) Field of Classification Search
CPC .... A61J 1/165; A61J 2200/44; A61J 2200/42; A61J 2200/50; F25D 17/047; F25D 17/045; F25D 17/06
See application file for complete search history.

(56) References Cited

U.S. PATENT DOCUMENTS

2019/0282445 A1* 9/2019 Liao ..... B01L 1/025

* cited by examiner

*Primary Examiner* — Cassey D Bauer
(74) *Attorney, Agent, or Firm* — Schwegman Lundberg & Woessner, P.A.

(57) ABSTRACT

A medical fluid storage and transportation enclosure can include a housing, a chamber, an exhaust duct, an inlet duct, and a valve. The housing can include walls defining a cavity, where the cavity can be configured to receive a medical product therein. The chamber can be adjacent to the cavity and can be configured to exchange heat with the cavity. The valve can be located in the inlet duct, where the valve can be movable in response to an air.

20 Claims, 4 Drawing Sheets

MEDICAL PRODUCT TRANSPORTATION AND STORAGE ENCLOSURE WITH DIRECTED COOLING AND HEATING

CLAIM OF PRIORITY

This patent application claims the benefit of priority, under 35 U.S.C. Section 119(e), to Andreas Vlahinos, U.S. Patent Application Ser. No. 62/640,531, entitled "MEDICAL FLUID TRANSPORTATION ENCLOSURE WITH DIRECTED COOLING," filed on Mar. 8, 2018 which is hereby incorporated by reference herein in its entirety.

BACKGROUND

The present disclosure relates generally to transportation devices for medical fluids. In various circumstances, medical fluids may require transportation. For example, vials of a vaccine or tubes of blood may be transported between medical facilities or laboratories. Some of the fluids requiring transport may be damaged by relatively extreme ambient conditions such as high or low temperatures.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

To accommodate transportation of temperature sensitive fluids, containers having passive or active temperature control can be used. Some medical transportation enclosures can use active cooling to maintain an internal temperature of the enclosure during transportation of the fluids. Some active cooling systems can use ambient air to cool one or more cavities within the enclosure and can use forced convection to transfer heat between the fluids and the ambient environment. However, some of these devices using forced convection may be inefficient such as due to heat loss during off-cycles of heating and/or cooling.

The techniques of this disclosure can help provide a solution to these issues such as through use of a cooling or heating system, such as having one or more doors or valves.

To limit transfer of heat to or from the tubes or fluids, the tubes (or other medical products) can be stored in a cavity, separate from or adjacent to an air chamber that receives ambient air. The chamber and the cavity can be thermally connected, such as through a heat sink or an active cooling device (such as a thermo-electric cooler, or Peltier device).

Also, one or more ducts can include one or more valves or doors, such as two, three, or more doors. Each door can include a living hinge or flexible connection portion that can allow each door to be configured to allow air flow in only one direction, such as in response to air pressure provided by a fan or blower. This can help limit unwanted circulation between the air chamber and the ambient environment, such as when ambient conditions are unfavorable for cooling. For example, conditions may be unfavorable when a container is outside on a summer day and the valve may be in a closed position, helping to limit the unwanted warm air from exchanging heat with the specimens or samples. However, the same valve(s) can allow ambient air into the chamber when the ambient environment is favorable, for example, when the container or enclosure is on a refrigerated truck. The valves can also increase thermal efficiency such as by including or being comprised of insulation, such as being comprised of a foam that defines the duct or ducts. The insulation of the valve can serve as a thermal break between the chamber and the ambient environment, which can further increase operational efficiency. Because the valves or doors can be formed of the insulation, manufacturing cost can be reduced.

Figure 1:
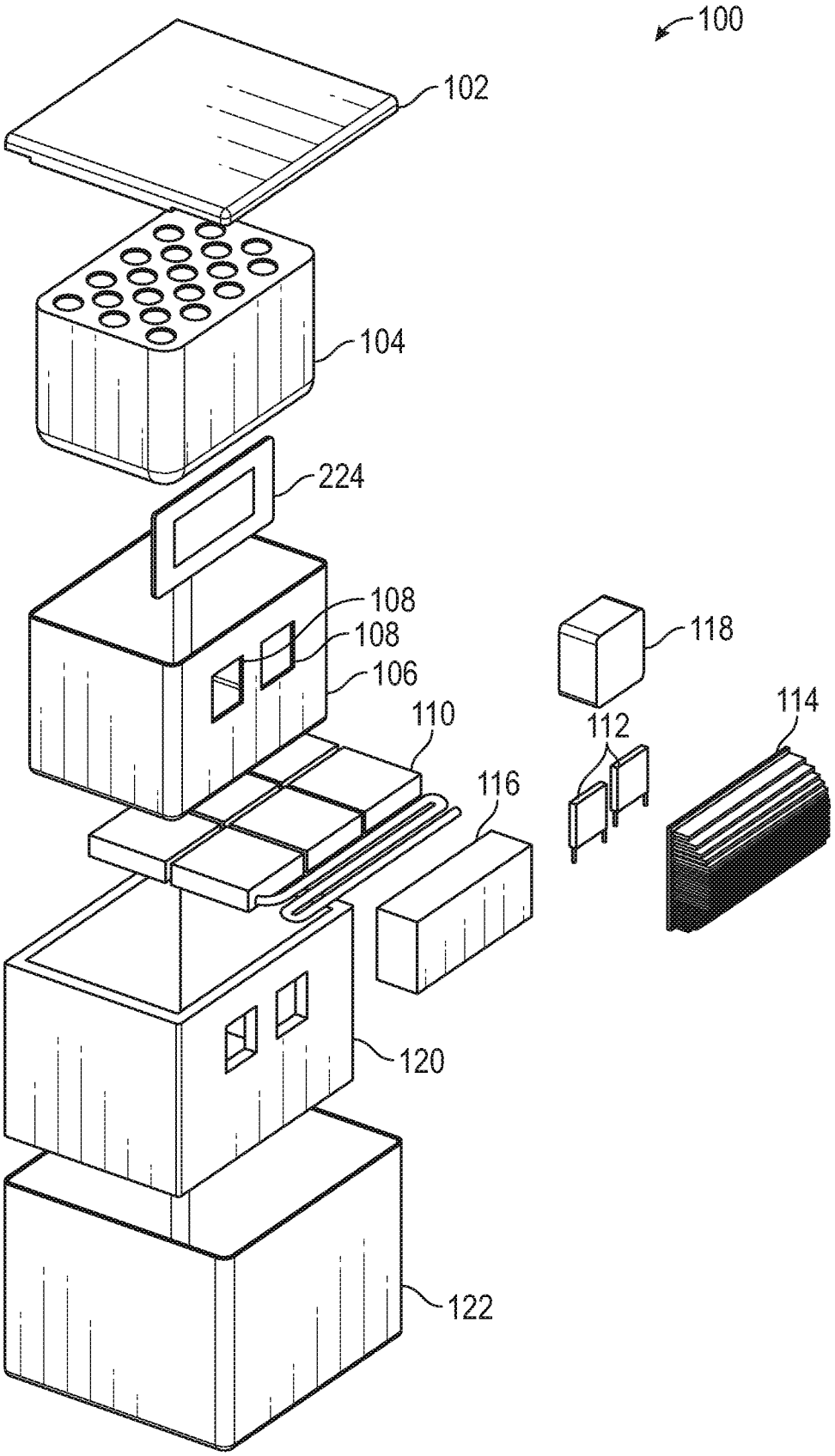
FIG. 1 illustrates an exploded view of a transportation enclosure, in accordance with at least one example of this disclosure.

FIG. 1 illustrates an exploded view of a transportation enclosure 100, in accordance with at least one example of this disclosure. The transportation enclosure 100 can include a lid 102, a housing 104, a cooling device 106 (including openings 108), a power supply 110, heating/cooling devices 112, a heat exchanger 114, control modules 116, a heat sink 118, insulation 120, and a container 122.

The components of the transportation enclosure 100 can be made of one or more of metals, plastics, foams, elastomers, ceramics, composites, combinations thereof or the like. Many of the components of the enclosure 100 can be made of insulative materials, such as one or more of plastics, foams, or the like to help maintain a desired temperature within the enclosure 100.

The lid 102 can be an insulative lid configured to enclose one or more sides of the enclosure 100. The lid 102 can be releasably securable to the container 122 via interference fit or other temporary locking interface such as through use of a set of clips.

The housing 104 can be a support structure configured to releasably secure one or more tubes, vials, specimen containers, various medical products, or the like. The cooling device 106 can be a housing sized and shaped to enclose one or more cooling components and the housing 104. The cooling device 106 can include one or more openings 108 extending therethrough.

The power supply 110 can be a battery and circuitry configured to provide power to the heating and cooling devices 112 during transportation of the enclosure 100. The power supply 110 can be rechargeable in some examples. The heating/cooling devices 112 can be one or more devices configured to provide heating and/or cooling to the cooling device 106 and the contents therein. The heating/cooling devices 112 can be located at least partially within the openings 108 for thermal interaction with the cooling device 106. The heating/cooling devices 112 can be thermoelectric coolers (such as Peltier coolers) or other heatpump devices using, for example refrigerant, to heat and cool the cooling device 106 and the contents therein. In some examples, the heating/cooling devices 112 can be only a heating device or only a cooling device, depending on the requirements of the contents of the enclosure 100.

The heat exchanger 114 can be supported by the container 122 and in thermal communication with the cooling devices 112 and an ambient environment (i.e. outside of the container 122). In some examples, the heat exchanger 114 can extend outside of the container 122. In some examples, the heat exchanger can be in direct contact with the heating/cooling devices 112 to allow for conduction therebetween.

The control modules 116 can include one or more devices for controlling operation of the enclosure 100, such as one or more temperature sensors, and a controller. The control modules 116 can be connected to the power supply 110 and the heating/cooling devices 112 to distribute power to the heating/cooling devices 112 and to control the operation of the heating/cooling devices 112. The control modules 116 can include a programable controller, such as a single or multi-board computer, a direct digital controller (DDC), or a programable logic controller (PLC). In other examples the controller can be any computing device, such as a handheld computer, for example, a smart phone, a tablet, a laptop, a desktop computer, or any other computing device including a processor and wireless communication capabilities.

The heat sink 118 can be a heat exchanger for exchanging heat between samples within the housing 104 and the heating/cooling devices 112, either directly or indirectly. In some examples, the heat sink 118 can be comprised of a material having a high thermal conductivity such as one or more of copper, aluminum, or the like. The heat sink 118 can include one or more fins to help improve heat transfer.

The insulation 120 can be positioned within the container 122 and can be configured to help thermally isolate the components within the container 122 such as the samples supported by the housing 104. The container 122 can be a rigid or semi-rigid body configured to protect, together with the insulation 120, items within the housing 104, such as the housing 104 (its contents), the heating/cooling devices 112, etc. The container 122 can include walls 123 defining a cavity therein, where the cavity can receive the various components of the enclosure 100. Operation of these and similar components is discussed below with respect to FIGS. 2-4B.

Figure 2:
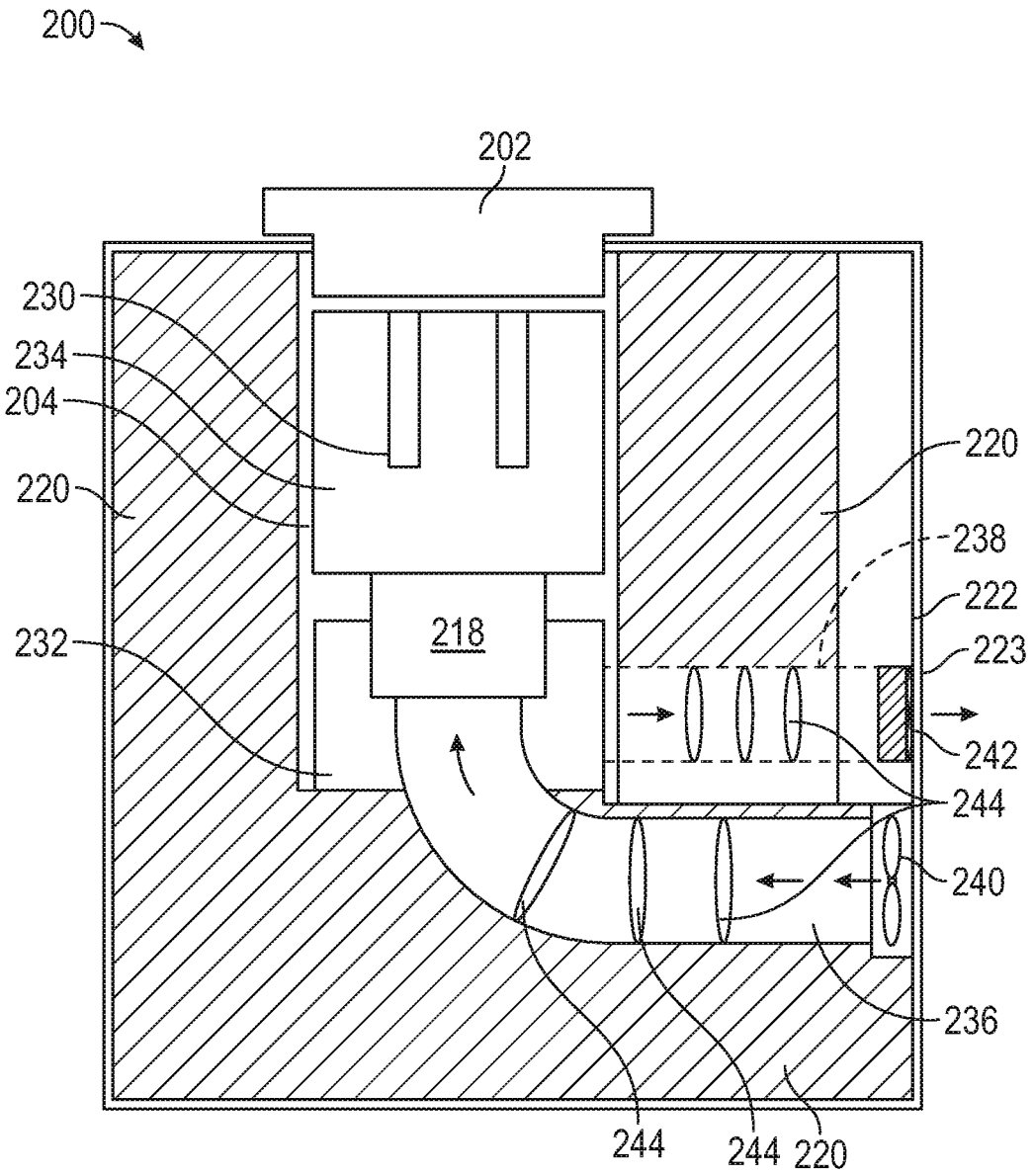
FIG. 2 illustrates a cross-sectional elevation and schematic view of a portion of a transportation enclosure, in accordance with at least one example of this disclosure.

FIG. 2 illustrates a cross-sectional elevation and schematic view of a portion of a transportation enclosure 200, in accordance with at least one example of this disclosure. The transportation enclosure 200 can include a lid 202, a housing 204, insulation 220, a container 222, samples 230, a chamber 232, a cavity 234, an intake duct 236, an exhaust duct 238, a fan 240, an exhaust louver 242, and valves 244. Though not shown in FIG. 2, the enclosure 200 can also include a cooling device, a power supply, heating/cooling devices, a heat exchanger, and/or control modules, as shown in the enclosure 100 of FIG. 1.

The samples 230 can be vials or tubes containing specimens or samples of fluids, for example. In other examples, the samples 230 can be any other temperature sensitive material requiring transportation, such as other medical products. The cavity 234 can be a cavity or open space around the samples 230 and can be formed of/surrounded by walls defined by the container 204. The walls can be comprised of insulation for temperature control of the cavity 234 and therefore of the samples 230.

The chamber 232 can be a cavity or open space around a portion of the heat sink 218 where the chamber 232 can be formed of/surrounded by insulation for temperature control of the chamber 232. The heat sink 218 can extend between the cavity 234 and the chamber 232 for exchange of heat between the cavity 234 and the chamber 232 where the insulation surrounding he cavity 234 and the chamber 232 can help to thermally isolate the cavity 234 from the chamber 232.

The intake duct 236 and the exhaust duct 238 can each be ducts extending through an outer wall 223 of the container 222 and into the insulation 220 to connect to the chamber 232 to connect the chamber 232 with the ambient environment. The intake duct 236 can transmit fresh air to the heat sink 218 and the exhaust duct can transmit used process air from the heat sink 218 to the ambient environment. The intake duct 236 and the exhaust duct 238 can each be partially or entirely formed by the insulation 220.

As shown in FIGS. 1, 2, 3A, 3B, 4A, and 4B, the intake duct and exhaust duct can include insulation, such as defining outer walls of the intake duct. The walls can include or can be made of thermally insulative materials such as fiberglass, polyethylene, ethylene propylene diene monomer rubber, or the like. In some examples, the insulation portion (walls) can include or can be made of flexible insulation.

The fan 240 can be one or more fans or pumps configured to motivate air to flow. The fan 240 can be an axial, centrifugal (plug), or the like and can be located in the intake duct 236 adjacent to an opening in the container 222 to connect the fan 240 to an ambient environment. In other examples, the fan 240 can be in other positions in the intake duct 236, the exhaust duct 238, mounted to the heat sink 218, and/or in the chamber 232. One or more fans can be used in series or parallel flow configurations. The louver 242 can be an exhaust louver located in an opening in the side of the container 222 and can be connected to the exhaust duct. In some examples, the louver 242 can include an exhaust fan.

The valves 244 can be valves formed in part or entirely by insulation and can be located in the intake duct 236 and the exhaust duct 238 and can extend across one of the intake ducts 236 and the exhaust duct 238.

In operation of some examples, the tubes or samples 230 can be placed in the cavity 234 and the lid 202 can be secured to the container 222. A controller (such as the controller of the modules of FIG. 1) can determine a temperature within the cavity 234 and/or of the tubes 230 and can determine if the temperature(s) are within a desired temperature range. When heating or cooling that requires ambient air is needed to maintain the temperature range within the cavity 234, the fan 240 can be powered on. The fan 240 can deliver ambient air to the intake duct 236 and the valves 244 can open due to forces from the air flow. The valves 244 can remain open while the fan 240 provides sufficient air pressure to keep the valves 244 open. The air can be delivered to the heat sink 218 to heat or cool the heat sink 218, which can then heat or cool the cavity 234. Air can exit the heat sink and enter the chamber 232 where it can be delivered to the exhaust duct 238. Similar to the valves 244 of the intake duct 236, the valves 244 of the exhaust duct 238 can open due to the air pressure, allowing air to exhaust through the louver 242 to the ambient environment.

Figure 3B:
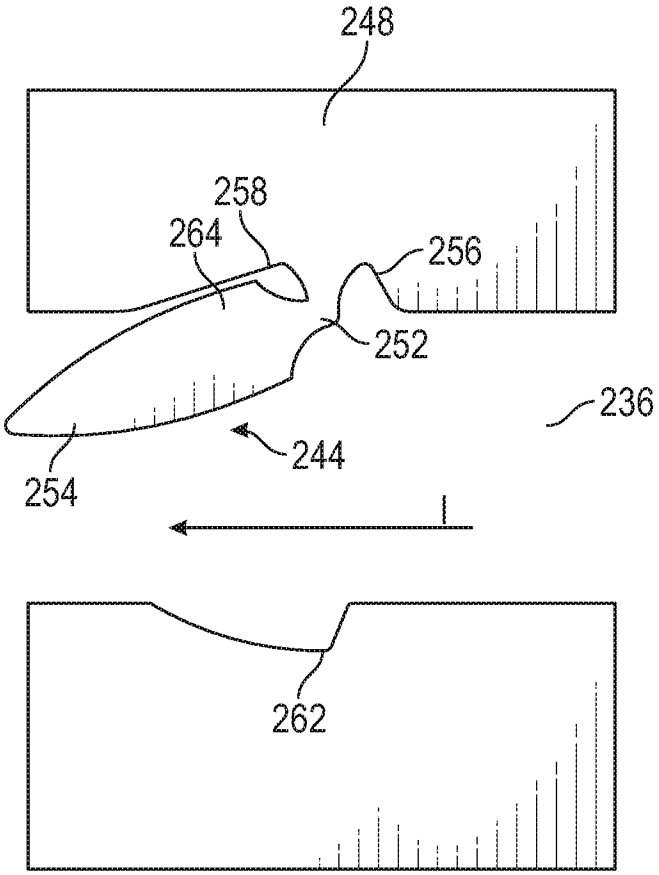
FIG. 3B illustrates an elevation view of a portion of a transportation enclosure in a second condition, in accordance with at least one example of this disclosure.
Figure 3A:
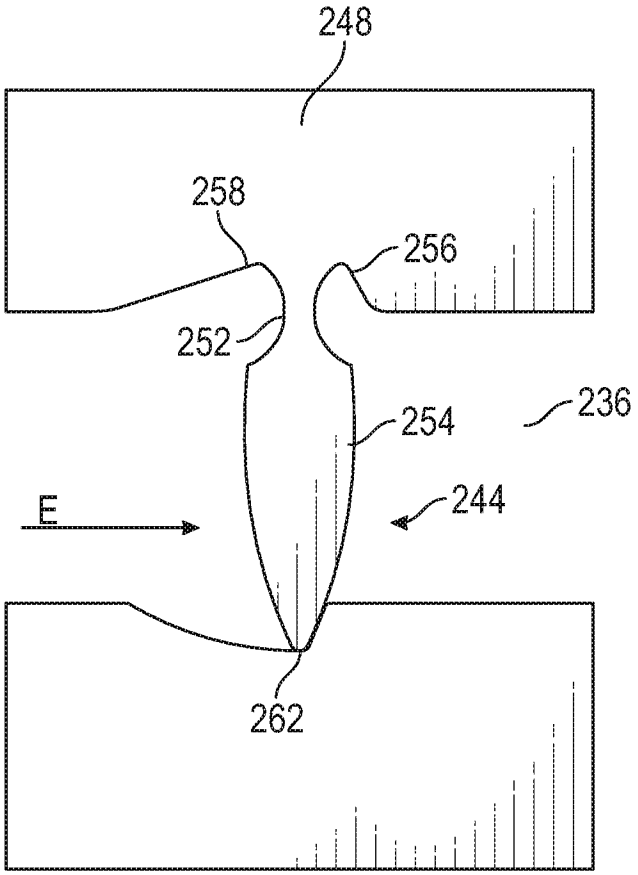
FIG. 3A illustrates an elevation view of a portion of a transportation enclosure in a first condition, in accordance with at least one example of this disclosure.
Figure 4B:
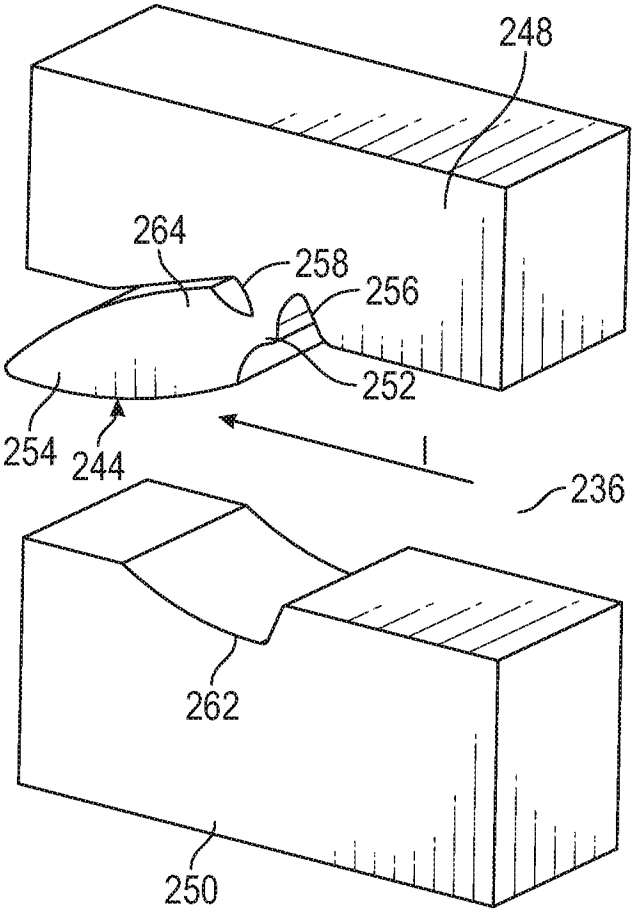
FIG. 4B illustrates a perspective view of a portion of a transportation enclosure in a second condition, in accordance with at least one example of this disclosure.
Figure 4A:
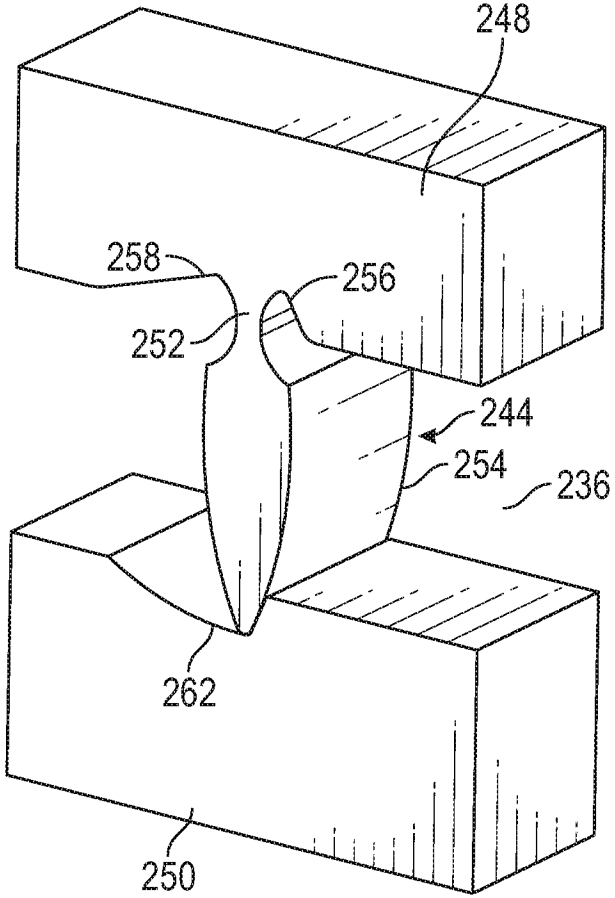
FIG. 4A illustrates a perspective view of a portion of a transportation enclosure in a first condition, in accordance with at least one example of this disclosure.

When heating or cooling using ambient air is no longer required, the fan can be powered off and the valves 244 can return to a closed position. The valves 244 can thereby act as one-way dampers or check valves to control the flow of air through the enclosure by allowing air to flow during cooling or heating operations where ambient air is required and by preventing air from circulating through the intake duct 236 and the exhaust duct 238 and the ambient environment when ambient air is not required. In some examples, the valves 244 can be made of the insulation material to help limit heat transfer between the tubes 230 and the ambient environment when the fan is off 240. Further, by using insulation, the valves 244 can be relatively light weight to help the valves 244 open in response to air pressure. The valve or door 244 can extend from one of the insulation portions of the intake duct and the exhaust duct into the duct, such as shown in FIGS. 2, 3A and 4A. In some examples, valves can be included in only one duct. In some examples, a series of valves can be included, such as 1, 2, 3, 4, or more valves in each of the exhaust and intake duct, such as shown in FIG. 2. In other examples, valves can be used in parallel flow paths in the exhaust and/or the intake duct.

In some examples, the convection cooling components of FIG. 2 can be used in the enclosure 100 of FIG. 1, for example in place of or in addition to the heat exchanger 114 to provide ambient air to the heat sink 118 and to exhaust air from the heat sink 118 to the ambient environment.

FIG. 3A illustrates an elevation view of a portion of a transportation enclosure in a first condition, in accordance with at least one example of this disclosure. FIG. 3B illustrates an elevation view of a portion of a transportation enclosure in a second condition, in accordance with at least one example of this disclosure. FIG. 4A illustrates a perspective view of a portion of a transportation enclosure in a first condition, in accordance with at least one example of this disclosure. FIG. 4B illustrates a perspective view of a portion of a transportation enclosure in a second condition, in accordance with at least one example of this disclosure. FIGS. 3A-4B are discussed below concurrently.

The portion of the transportation enclosure can include the valve 244 and insulation portions 248 and 250 defining the intake duct 236. The valve 244 can include a living hinge 252, a body 254, channels 256 and 258, and a lip 260. The insulation portion 250 can include a notch 262.

The valve or door 244 can extend from the insulation portion 248 into the inlet duct 236, such as shown in FIGS. 3A and 4A. Similarly, a valve or door can extend from one of the insulation portions into the exhaust duct 238. The valve can include a "living" hinge 252 connecting a body 254 of the valve 244 to the insulation portion 248, where the living hinge 252 can be partially defined by channels 256 and 258 upstream and downstream, respectively, of the connection location of the body 254 of the valve 244 to the insulation portion 248. Together with the body 254 of the valve 244 and insulation portion 248, the living hinge 248 can form a resilient hinge, so as to allow the valve 244 to operate like a pressure-responsive damper. Though the hinge 252 is shown as being connected to a top portion of the valve 244 relative to the page, the hinge 252 can connect a bottom portion of the valve to the insulation portion 250 in some examples, and can be connected to a side of the valve in other examples.

The valve 244 can extend distally from its connection location to the wall or insulation portion, extending across an entirety of the duct 236 to form a seal therein when the valve is in a first position (or closed position), such as shown in FIGS. 3A and 4A. The lip 260 or distal tip of the valve can be disposed in the notch 262 of an opposite insulation wall of the insulation portion 250 from the connection location, such as to help provide an affirmative seal and to help limit movement of the valve or door in response to exhaust flows.

In operation, the heat sink 218 can include an active cooling or heating device that exchanges heat between the cavity and the chamber. When there is a difference between the heat exchanger there may be desirable heat transfer and the ambient temperature the active heating/cooling device can be on. When heat transfer between the heat exchanger and the environment is undesirable, the heating/cooling device(s) can be off. When the heating/cooling device(s) are off, it may be desirable to try to limit airflow from the chamber 232 to the environment. The passive valve doors 244 can provide this function without any control system. When one or more of the fans 240 are on, the valve/doors 244 can open automatically. When the fans are off, the doors 244 can close and can help to insulate the chamber from the environment.

In operation of some examples, as shown in FIGS. 3A and 4A, the valve 244 can be in a closed position when no air pressure is present (as shown in FIG. 4A) or when opposing intake and/or exhaust air pressure is present (as when in FIG. 3A) (as indicated by arrow E). This can help limit unintentional movement of air out of the chamber (of FIG. 2), which can help limit unwanted intake through the intake and exhaust ducts 236 and 238.

When it is desired to bring in ambient air (for heating or cooling of the chamber), the intake fan 240 or other airflow assistance device can be activated, such as to create an intake air flow (shown by arrow I in FIGS. 3B and 4B). Similarly, an exhaust fan can create an exhaust airflow in the exhaust duct. Pressure and forces generated by the intake (and/or exhaust) air flow can cause the valve 244 to move in the direction of the intake air flow as the valve flexes at the living hinge 252 proximate the insulation duct wall. The reduced thickness of the valve 244 at a connection point with the insulation wall and/or the channels of the wall can enable movement of the valve 244 between the first position and the second position in response to intake air flow pressure. In some examples, the downstream channel 258 can be larger and can include a tapered portion sized and shaped to receive the valve 244 therein when the valve is in the open position. The recess or taper of the downstream channel 258 can allow a proximal and downstream portion 264 of the valve 244 to nest within the channel 258 to help create a larger flow path for air moving past the valve 244.

Movement of the valve 244 to an open position can create an open flow path in the intake duct 236 and exhaust duct 238 that allows ambient air to enter the chamber and exit the exhaust duct for heat exchange with the heat sink 218 (and indirectly with the cavity, tubes, and liquids therein). When the intake air flow is eliminated or reduced, the resiliency of the living hinge 252 (or compliance member) of intake duct valves can cause the valve 244 to return to a closed position to again prevent unintentional airflow through the intake duct 236. Similarly, in response to elimination or reduction of the exhaust air flow, the resiliency of the living hinge (or compliance member) of exhaust duct valves can cause the valve to return to a closed position to again prevent unintentional airflow through the exhaust duct.

These operations of the valve(s) 244 can help limit unwanted circulation between the air chamber and the ambient environment when ambient conditions are unfavorable for cooling (or heating), while allowing ambient air into the chamber when the ambient environment is favorable, for example, when the container or enclosure is on a conditioned truck. The valve(s) 244 can also increase thermal efficiency by being comprised of insulation, such as foam, that defines the duct or ducts. The insulation of the valve can serve as a thermal break between the chamber and the ambient environment, which can further increase operational efficiency. Because the valves or doors can be formed of the insulation, manufacturing cost can be reduced.

In one example, one or more doors 244 can be included in the air intake chamber, where the door cutout with hinge is a part of the insulation, which can include or be foam in some examples. The door or valve 244 can be connected to the insulation through a compliance mechanism or living hinge, such as where the living hinge has the ability to bend in response to air pressure to open the valve and can return to a closed position when the pressure is removed or reduced. Because the valve can include or be comprised of insulation, such as foam, the valve provides a thermal break between an ambient environment and air within the cavity or chamber, which can help preserve energy.

Notes and Examples

The following, non-limiting examples, detail certain aspects of the present subject matter to solve the challenges and provide the benefits discussed herein, among others.

Example 1 is a medical fluid transportation enclosure comprising: a housing including walls defining a cavity, the cavity configured to receive storage tubes therein; a chamber adjacent to the cavity and configured to exchange heat with the cavity; an exhaust duct connected to the chamber and extending through an outer wall of the housing; an inlet duct connected to the chamber in parallel with the exhaust duct, the inlet duct extending through an outer wall of the housing; and a valve located in the inlet duct, the valve movable, in response to an air pressure, between a first position and a second position, the valve configured to allow air flow into the chamber through the inlet duct when the valve is in the first position, and the valve configured to prevent air flow out of the chamber through the inlet duct when the valve is in the second position.

In Example 2, the subject matter of Example 1 optionally includes an insulation portion at least partially defining the chamber, the insulation portion defining the inlet duct.

In Example 3, the subject matter of Example 2 optionally includes wherein the valve is formed using the insulation portion and extends into the inlet duct from the insulation portion.

In Example 4, the subject matter of Example 3 optionally includes wherein the valve is connected to the insulation portion through a living hinge, the living hinge enabling movement of the valve between the first position and the second position.

In Example 5, the subject matter of Example 4 optionally includes a notch in the insulation portion opposite the living hinge, the notch configured to receive a tip of the valve to form a seal to prevent air flow out of the chamber through the inlet duct when the valve is in the second position.

In Example 6, the subject matter of any one or more of Examples 4-5 optionally include wherein the living hinge is formed by a reduced thickness portion of the valve at a connection point between the valve and the insulation portion.

In Example 7, the subject matter of Example 6 optionally includes wherein the living hinge is formed by first and second channels disposed on upstream and downstream sides of the connection point.

In Example 8, the system, assembly, or method of any one of or any combination of Examples 1-7 is optionally configured such that all elements or options recited are available to use or select from.

Example 9 is a medical product transportation and storage enclosure comprising: a housing including walls defining a cavity, the cavity configured to receive a medical product therein; a chamber adjacent to the cavity and configured to exchange heat with the cavity; a container including outer walls and configured to receive the housing therein; an exhaust duct connected to the chamber and extending through an outer wall of the container; an inlet duct connected to the chamber and extending through the outer wall of the container; and a valve located in the inlet duct, the valve movable, in response to an air pressure, between a first position and a second position, the valve configured to allow air flow into the chamber through the inlet duct when the valve is in the first position, and the valve configured to prevent air flow out of the chamber through the inlet duct when the valve is in the second position.

In Example 10, the subject matter of Example 9 optionally includes an insulation portion at least partially defining the chamber, the insulation portion defining the inlet duct.

In Example 11, the subject matter of Example 10 optionally includes wherein the valve is formed using the insulation portion and extends into the inlet duct from the insulation portion.

In Example 12, the subject matter of Example 11 optionally includes wherein the valve is connected to the insulation portion through a living hinge, the living hinge enabling movement of the valve between the first position and the second position.

In Example 13, the subject matter of Example 12 optionally includes a notch in the insulation portion opposite the living hinge, the notch configured to receive a tip of the valve to form a seal to prevent air flow out of the chamber through the inlet duct when the valve is in the second position.

In Example 14, the subject matter of any one or more of Examples 12-13 optionally include wherein the living hinge is formed by a reduced thickness portion of the valve at a connection point between the valve and the insulation portion.

In Example 15, the subject matter of Example 14 optionally includes wherein the living hinge is formed by first and second channels disposed on upstream and downstream sides of the connection point.

Example 16 is a medical product transportation system comprising: a container including outer walls; a housing positionable within the container, the housing defining a cavity configured to receive a medical product therein; a chamber adjacent to the cavity and configured to exchange heat with the cavity; an exhaust duct connected to the chamber and extending through an outer wall of the housing; an inlet duct connected to the chamber and extending through the outer wall of the housing; a fan connected to the inlet duct and configured to deliver air from an ambient environment to the chamber through the inlet duct, and a valve located in the inlet duct, the valve movable, in response to an air pressure, between an open position and a closed position, the valve to allow air flow into the chamber through the inlet duct when the valve is open, and the valve configured to prevent air flow out of the chamber through the inlet duct when the valve is closed.

In Example 17, the subject matter of Example 16 optionally includes an insulation portion at least partially defining the chamber, the insulation portion defining the inlet duct.

In Example 18, the subject matter of Example 17 optionally includes wherein the valve is formed of the insulation portion and extends into the inlet duct from the insulation portion.

In Example 19, the subject matter of Example 18 optionally includes wherein the valve includes a living hinge connecting a body of the valve to the insulation portion, the living hinge enabling movement of the valve between the open position and the closed position.

In Example 20, the subject matter of any one or more of Examples 18-19 optionally include a notch in the insulation portion opposite the living hinge, the notch configured to receive a tip of the valve to form a seal to prevent air flow out of the chamber through the inlet duct when the valve is in the closed position.

In Example 21, the subject matter of any one or more of Examples 18-20 optionally include wherein the living hinge is formed by a reduced thickness portion of the body of the valve at a connection point between the valve and the insulation portion.

In Example 22, the subject matter of Example 21 optionally includes wherein the living hinge is formed in part by first and second channels disposed on upstream and downstream sides of the connection point.

In Example 23, the subject matter of Example 22 optionally includes wherein the downstream channel is configured to receive a proximal portion of the body of the valve therein when the valve is in the open position.

In Example 24, the subject matter of any one or more of Examples 16-23 optionally include an exhaust louver connected to the exhaust duct adjacent the outer wall of the container.

In Example 25, the subject matter of any one or more of Examples 16-24 optionally include a heat sink connected to cavity and the chamber to exchange heat therebetween.

In Example 26, the subject matter of Example 25 optionally includes wherein the intake duct is directly connected to the heatsink to deliver ambient air thereto.

In Example 27, the subject matter of any one or more of Examples 16-26 optionally include a second valve located in the exhaust duct, the second valve movable in response to an air pressure between an open position and a closed position, the second valve to allow air flow out of the chamber through the exhaust duct when the second valve is open, and the second valve configured to prevent air flow into of the chamber through the exhaust duct when the second valve is closed.

In Example 28, the subject matter of Example 27 optionally includes a third valve located in the exhaust duct in series with the second valve.

Example 29 is a method of transporting a medical product, the method comprising: receiving a medical product within a cavity of a housing adjacent a chamber; exchanging heat between the chamber and the cavity using flow entering an inlet duct connected to the chamber between and exiting an exhaust duct connected to the chamber; allowing air flow into the chamber through the inlet duct when a valve is in a first position.

In Example 30, the subject matter of Example 29 optionally includes limiting air flow out of the chamber through the inlet duct when the valve is in the second position.

In Example 31, the apparatuses, systems, or method of any one or any combination of Examples 1-30 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein," Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R, § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A medical product transportation and storage enclosure comprising:

a housing including walls defining a cavity, the cavity configured to receive a medical product therein;

a chamber adjacent to the cavity and configured to exchange heat with the cavity;

a container including outer walls and configured to receive the housing therein;

an exhaust duct connected to the chamber and extending through an outer wall of the container;

an inlet duct connected to the chamber and extending through the outer wall of the container; and a valve located in the inlet duct, the valve movable, in response to an air pressure, between a first position and a second position, the valve configured to allow air flow into the chamber through the inlet duct when the valve is in the first position, and the valve configured to inhibit or prevent air flow out of the chamber through the inlet duct when the valve is in the second position.

2. The medical product transportation and storage enclosure of claim 1, further comprising:

an insulation portion at least partially defining the chamber, the insulation portion defining the inlet duct.

3. The medical product transportation and storage enclosure of claim 2, wherein the valve is formed using the insulation portion and extends into the inlet duct from the insulation portion.

4. The medical product transportation and storage enclosure of claim 3, wherein the valve is connected to the insulation portion through a living hinge, the living hinge enabling movement of the valve between the first position and the second position.

5. The medical product transportation and storage enclosure of claim 4, further comprising:

a notch in the insulation portion opposite the living hinge, the notch configured to receive a tip of the valve to form a seal to prevent air flow out of the chamber through the inlet duct when the valve is in the second position.

6. The medical product transportation and storage enclosure of claim 4, wherein the living hinge is formed by a reduced thickness portion of the valve at a connection point between the valve and the insulation portion.

7. The medical product transportation and storage enclosure of claim 6, wherein the living hinge is formed by first and second channels disposed on upstream and downstream sides of the connection point.

8. A medical product transportation system comprising:

a container including outer walls;

a housing positionable within the container, the housing defining a cavity configured to receive a medical product therein;

a chamber adjacent to the cavity and configured to exchange heat with the cavity;

an exhaust duct connected to the chamber and extending through an outer wall of the housing;

an inlet duct connected to the chamber and extending through the outer wall of the housing;

a fan connected to the inlet duct and configured to deliver air from an ambient environment to the chamber through the inlet duct, and a valve located in the inlet duct, the valve movable, in response to an air pressure, between an open position and a closed position, the valve to allow air flow into the chamber through the inlet duct when the valve is open, and the valve configured to prevent air flow out of the chamber through the inlet duct when the valve is closed.

9. The system of claim 8, further comprising:

an insulation portion at least partially defining the chamber, the insulation portion defining the inlet duct.

10. The system of claim 9, wherein the valve is formed of the insulation portion and extends into the inlet duct from the insulation portion.

11. The system of claim 10, wherein the valve includes a living hinge connecting a body of the valve to the insulation portion, the living hinge enabling movement of the valve between the open position and the closed position.

12. The system of claim 10, further comprising:

a notch in the insulation portion opposite the living hinge, the notch configured to receive a tip of the valve to form a seal to prevent air flow out of the chamber through the inlet duct when the valve is in the closed position.

13. The system of claim 10, wherein the living hinge is formed by a reduced thickness portion of the body of the valve at a connection point between the valve and the insulation portion.

14. The system of claim 13, wherein the living hinge is formed in part by first and second channels disposed on upstream and downstream sides of the connection point.

15. The system of claim 14, wherein the downstream channel is configured to receive a proximal portion of the body of the valve therein when the valve is in the open position.

16. The system of claim 8, further comprising:

an exhaust louver connected to the exhaust duct adjacent the outer wall of the container.

17. The system of claim 8, further comprising:

a heat sink connected to cavity and the chamber to exchange heat therebetween.

18. The system of claim 17, wherein the intake duct is directly connected to the heatsink to deliver ambient air thereto.

19. The system of claim 8, further comprising a second valve located in the exhaust duct, the second valve movable in response to an air pressure between an open position and a closed position, the second valve to allow air flow out of the chamber through the exhaust duct when the second valve is open, and the second valve configured to prevent air flow into of the chamber through the exhaust duct when the second valve is closed.

20. The system of claim 19, further comprising a third valve located in the exhaust duct in series with the second valve.

* * * * *